US009368316B2

(12) United States Patent
Jeong et al.

(10) Patent No.: US 9,368,316 B2
(45) Date of Patent: Jun. 14, 2016

(54) X-RAY TUBE HAVING ANODE ELECTRODE

(71) Applicant: Electronics and Telecommunications Research Institute, Daejeon (KR)

(72) Inventors: Jin Woo Jeong, Daejeon (KR); Yoon-Ho Song, Daejeon (KR); Sungyoul Choi, Ulsan (KR); Jun Tae Kang, Daegu (KR); Jae-woo Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 38 days.

(21) Appl. No.: 14/313,957

(22) Filed: Jun. 24, 2014

(65) Prior Publication Data

US 2015/0063549 A1 Mar. 5, 2015

(30) Foreign Application Priority Data

Sep. 3, 2013 (KR) ..... 10-2013-0105740
Jan. 16, 2014 (KR) ..... 10-2014-0005443

(51) Int. Cl.
*H01J 35/08* (2006.01)
*H01J 35/18* (2006.01)

(52) U.S. Cl.
CPC ..... *H01J 35/08* (2013.01); *H01J 35/18* (2013.01); *H01J 2235/081* (2013.01); *H01J 2235/086* (2013.01); *H01J 2235/186* (2013.01)

(58) Field of Classification Search
CPC ..... H01J 35/08; H01J 2235/087; H01J 2235/086; H01J 2235/084; H01J 35/14
See application file for complete search history.

(56) References Cited

U.S. PATENT DOCUMENTS

| | | | | |
|---|---|---|---|---|
| 4,903,287 | A * | 2/1990 | Harding | H01J 35/02 378/119 |
| 6,185,277 | B1 | 2/2001 | Harding | |
| 6,993,115 | B2 * | 1/2006 | McGuire | G21K 1/06 378/124 |
| 8,139,716 | B2 * | 3/2012 | Okunuki | H01J 35/065 378/122 |
| 8,199,881 | B2 | 6/2012 | Kim et al. | |
| 2012/0269326 | A1 * | 10/2012 | Adler | H01J 35/08 378/138 |
| 2014/0185778 | A1 | 7/2014 | Lee et al. | |
| 2014/0211919 | A1 * | 7/2014 | Ogura | H01J 35/08 378/62 |
| 2014/0369469 | A1 * | 12/2014 | Ogura | H01J 35/08 378/62 |

FOREIGN PATENT DOCUMENTS

| | | | |
|---|---|---|---|
| EP | 0244504 | B1 | 10/1993 |
| JP | H09-171788 | A | 6/1997 |
| JP | 3795028 | B2 | 7/2006 |
| JP | 2008-046130 | A | 2/2008 |
| JP | 2008-198522 | A | 8/2008 |
| JP | 2013-157269 | A | 8/2013 |

* cited by examiner

*Primary Examiner* — Hoon Song

(57) ABSTRACT

Provided is an X-ray tube. The X-ray tube includes an electrode on which an electron beam impacts to generate an X-ray, and a window on which the electrode is disposed and through which the X-ray generated from the electrode is transmitted. The electrode includes a channel passing through the electrode, and the electron beam is provided into the channel to generate the X-ray.

17 Claims, 4 Drawing Sheets

X-RAY TUBE HAVING ANODE ELECTRODE

CROSS-REFERENCE TO RELATED APPLICATIONS

This U.S. non-provisional patent application claims priority under 35 U.S.C. §119 of Korean Patent Application Nos. 10-2013-0105740, filed on Sep. 3, 2013, and 10-2014-0005443, filed on Jan. 16, 2014, the entire contents of which are hereby incorporated by reference.

BACKGROUND

The present invention relates to an X-ray tube, and more particularly, to an X-ray tube having an anode electrode in which a channel is formed.

In general, as illustrated in FIG. 1, an X-ray tube 9 having a transmissive anode structure includes an anode electrode 11 disposed on a window 10. An electron beam impacts on the anode electrode 11 to generate an X-ray, and the generated X-ray passes through the window 10 and then is released to the outside of the X-ray tube 9. Here, the anode electrode 11 may be minimized in thickness to restrain absorption of the X-ray.

To improve quality of an image of the X-ray, it is required that an accelerated electron beam which impacts on an X-ray target, i.e., the anode electrode 11 is focused to reduce a size of a focal spot of the X-ray. However, when the high energy electron beam focused onto a small area (for example, an area of micrometers to nanometers) impacts on the anode electrode 11, the anode electrode 11 may be damaged by heat.

As described above, in case of the transmissive anode structure, it may be difficult to satisfy high tube current, a high acceleration voltage, and emission of the X-ray for a long time. Therefore, it is needed to improve the X-ray tube so that the damage of the X-ray tube due to the heat is minimized.

SUMMARY

The present invention provides an X-ray tube which is capable of minimizing or removing damage due to heat.

Embodiments of the present invention provide X-ray tubes may include: an electrode on which an electron beam impacts to generate an X-ray; and a window on which the electrode is disposed and through which the X-ray generated from the electrode is transmitted. The electrode may include a channel passing through the electrode. The electron beam may be provided into the channel to generate the X-ray.

In some embodiments, the electrode may include a bottom surface into which the electron beam is incident and a top surface on which the window is disposed. The channel may extend from the bottom surface to the top surface to completely pass through the electrode.

In other embodiments, the channel may include an inlet at the bottom surface and an outlet at the top surface. The channel may have a width gradually decreasing from the inlet to the outlet.

In still other embodiments, the channel may have a hybrid structure including a lower channel having a truncated shape with an inclined inner sidewall extending from the inlet to the outlet and an upper channel having a cylindrical shape with a vertical inner sidewall extending from the lower channel. The electron beam may impact on the inclined inner sidewall of the lower channel to generate the X-ray.

In even other embodiments, the channel may include an inlet at the bottom surface and the outlet at the top surface. The channel may have the same width from the inlet to the outlet.

In yet other embodiments, the channel may have a unitary single structure having a cylindrical shape with a vertical sidewall extending from the inlet to the outlet. The electron beam may impact on the vertical sidewall to generate the X-ray.

In further embodiments, the channel may include a plurality of holes each having a vertical sidewall.

In other embodiments of the present invention, X-ray tubes may include: an X-ray window having a top surface facing the outside and a bottom surface facing the inside in a vacuum state; and an X-ray target provided on the bottom surface of the X-ray window. The X-ray target may impact with an electron beam traveling from the inside to generate an X-ray. The X-ray target may include a channel providing a traveling path through which the electron beam travels to the X-ray window.

In some embodiments, the channel may include at least one hole passing through the X-ray target. The at least one hole may include an inlet opened toward the inside and an outlet opened toward the X-ray window.

In other embodiments, the at least one hole may include a through hole of which the outlet has a diameter less than that of the inlet.

In still other embodiments, the through hole may include an inclined inner sidewall and a vertical inner sidewall which straightly extend from the inlet to the outlet. The electron beam may impact on the inclined inner sidewall to generate a locally focused X-ray released from the through hole.

In even other embodiments, the at least one hole may include a plurality of through holes each having a diameter of the inlet the same as that of the outlet.

In yet other embodiments, each of the through holes may include a vertical inner sidewall straightly extending from the inlet to the outlet. The electron beam may impact on the vertical inner sidewall to generate parallel X-rays released from the plurality of through holes.

In further embodiments, the X-ray target may include a polycrystalline or monocrystalline metal.

In still other embodiments of the present invention, X-ray tubes may include: an X-ray window having a top surface facing the outside in an atmospheric state and a bottom surface facing an inner space in a vacuum state; a metal target disposed on the bottom surface of the X-ray window, the metal target impacting with an electron beam traveling from the inner space to generate an X-ray; and at least one channel passing through the metal target along a traveling path to the outside of the electron beam. The at least one channel may have an inner sidewall impacting with the electron beam.

In some embodiments, the metal target may include an upper surface in contact with the bottom surface of the X-ray window and a lower surface opposite to the upper surface. The at least one channel may include: an inlet opened toward the lower surface of the metal target to be connected to the inner space; and an outlet opened toward the upper surface of the metal target to expose a portion of the top surface of the X-ray window.

In other embodiments, the at least one channel may include a hybrid structured hole including a lower channel having a truncated or wedge shape whose diameter gradually decreases from the inlet to the outlet and an upper channel having a cylindrical shape whose diameter does not change. The upper channel may extend from the lower channel.

In still other embodiments, the at least one channel may include a plurality of holes each having a cylindrical shape whose diameter of the inlet is the same as that of the outlet.

In even other embodiments, the metal target may include tungsten (W) or molybdenum (Mo).

In yet other embodiments, the X-ray window may include beryllium (Be).

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF EMBODIMENTS

Figure 1:
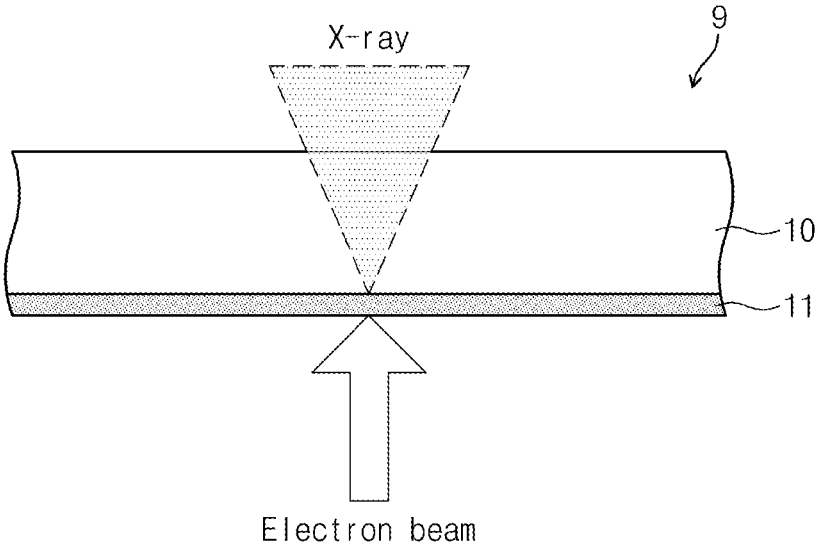
FIG. 1 is a cross-sectional view illustrating a general X-ray tube.

Hereinafter, an X-ray tube having an anode electrode according to the present invention will be described with reference to the accompanying drawings.

Advantages of the present invention in comparison with the related art will be clarified through the detailed description of preferred embodiments and the claims with reference to the accompanying drawings. In particular, the present invention is well pointed out and clearly claimed in the claims. The present invention, however, may be best appreciated by referring to the following detailed description of preferred embodiments with reference to the accompanying drawings. In the drawings, like reference numerals refer to like elements throughout.

First Embodiment

Figure 2A:
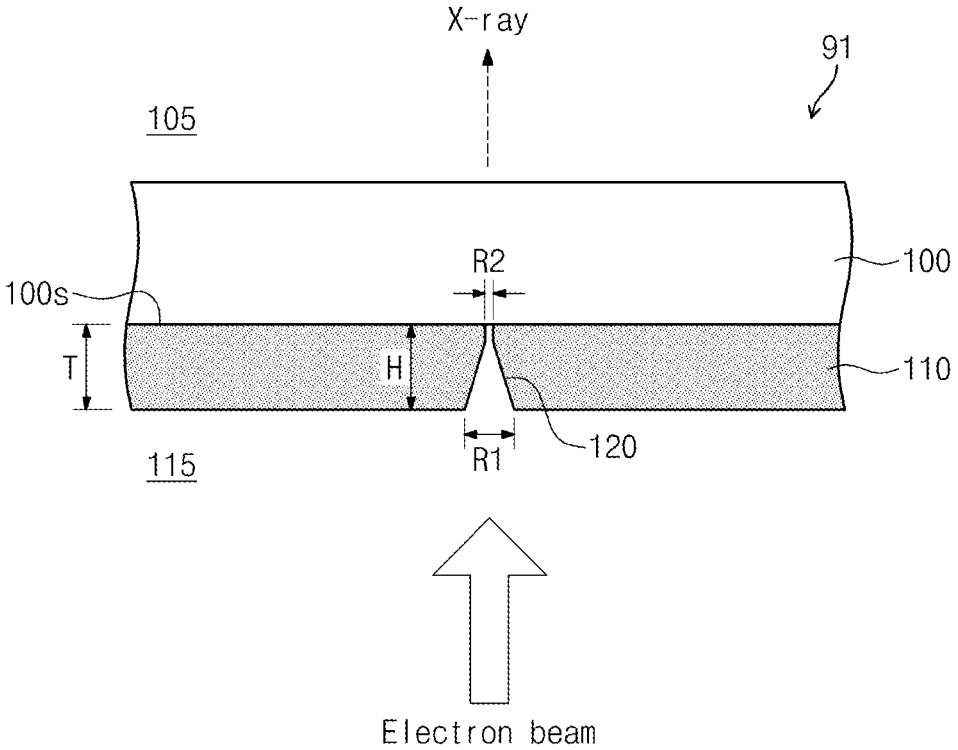
FIG. 2A is a cross-sectional view illustrating an X-ray tube according to an embodiment of the present invention.
Figure 2B:
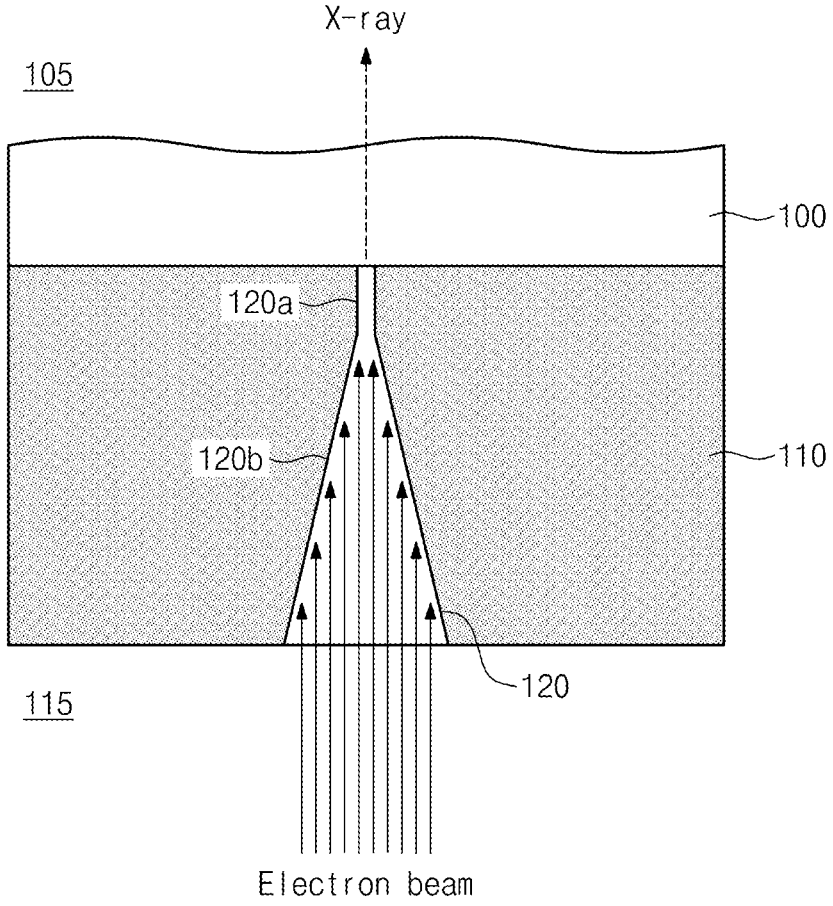
FIG. 2B is a cross-sectional view illustrating a portion of FIG. 2A.

FIG. 2A is a cross-sectional view illustrating an X-ray tube according to an embodiment of the present invention. FIG. 2B is a cross-sectional view illustrating a portion of FIG. 2A.

Referring to FIG. 2A, an X-ray tube 91 may have a transmissive anode structure including an anode electrode 110 which acts as an X-ray target from which the X-ray is generated due to an impact of an electron beam. An inner space 115 of the X-ray tube 91, which provides a moving path of the electron beam, may be maintained in a vacuum state. The X-ray tube 91 may be provided as a vacuum container in which a vacuum pump is installed or as a sealed vacuum container, and thus the inner space 115 may be maintained in the vacuum state. Generally, the outside of the X-ray tube 91 may be an atmospheric state.

The anode electrode 110 may include a metal, for example, tungsten (W) or molybdenum (Mo), which is formed on an inner surface 100*s* of the X-ray window 100 by a vapor deposition process (for example, a sputtering process). The anode electrode 110 may include a polycrystalline metal. Alternatively, the anode electrode 110 may include a monocrystalline metal so as to increase generation efficiency of the X-ray.

The window 100 may include a material having a low atomic number, for example, beryllium (Be), which absorbs a relatively less amount of X-ray when the X-ray passes therethrough while the inner space 115 of the X-ray tube 91 is maintained in the vacuum state. An accelerated electron beam having high energy (for example, several tens of kV to several hundreds of kV) may impact on the anode electrode 110 to generate the X-ray. The X-ray may be emitted to the outside 105 of the X-ray tube 91 through the window 100.

In some embodiments, the anode electrode 110 may be configured to minimize or remove damage due to heat. For example, the anode electrode 110 may include a channel 120 passing through the anode electrode, i.e., extending along a traveling path of the electron beam. The channel 120 may have an inlet that is opened toward the inner space 115 to be spatially connected to the inner space 115 and an outlet that is opened toward the window 110 to expose a portion of the inner surface 100*s* of the window 110. Here, the inlet may have a relatively large diameter R1, and the outlet may have a relatively small diameter R2 (where, R2<R1).

For example, as illustrated in FIG. 2B, the channel 120 may be a fine hole having a hybrid structure in which an upper channel 120*a* having a cylindrical shape is connected to a lower channel 120*b* having a truncated cone or wedge shape. The cylindrical-shaped upper channel 120*a* may have a substantially vertical inner sidewall, and the truncated con-shaped lower channel 120*b* may have an inclined inner sidewall extending in a straight line.

The channel 120 may have a size and shape which are properly set in consideration of a material of the anode electrode 100, electron beam energy, and the like. The anode electrode 100 may have a thickness that is properly selected in consideration of a height H and/or the diameters R1 and R2 of the channel 120.

Alternatively, the channel 120 may have a cylindrical shape of which a diameter R1 of the inlet is substantially the same as that R2 of the outlet. Differently, the anode electrode 110 may include two or more channels 120.

Referring to FIG. 2B, the accelerated electron beam may move into the inner space 115 and then be incident into the channel 120. The incident electron beam may impact on the inner sidewall of the channel 120, more particularly, on the inclined inner sidewall of the lower channel 120*b* to generate an X-ray. The generated X-ray may pass through the upper channel 120*b* and be emitted to the outside 105 through the window 100.

In some embodiments, the emitted X-ray may have a focal spot focused in a range of micrometer or less, for example, a range of nanometer. The focal spot of the X-ray may have a size mainly depending on the channel 120 illustrated in FIG. 2A, more particularly, the small diameter R2 of the upper channel 120A.

Since the electron beam impacts on the inner sidewall of the channel 120 having a relatively great area, the electron beam may have relatively low energy density when compared to that of the electron beam focused onto one spot. Therefore, the damage of the anode electrode 110 due to heat may be minimized or removed.

Second Embodiment

Figure 3A:
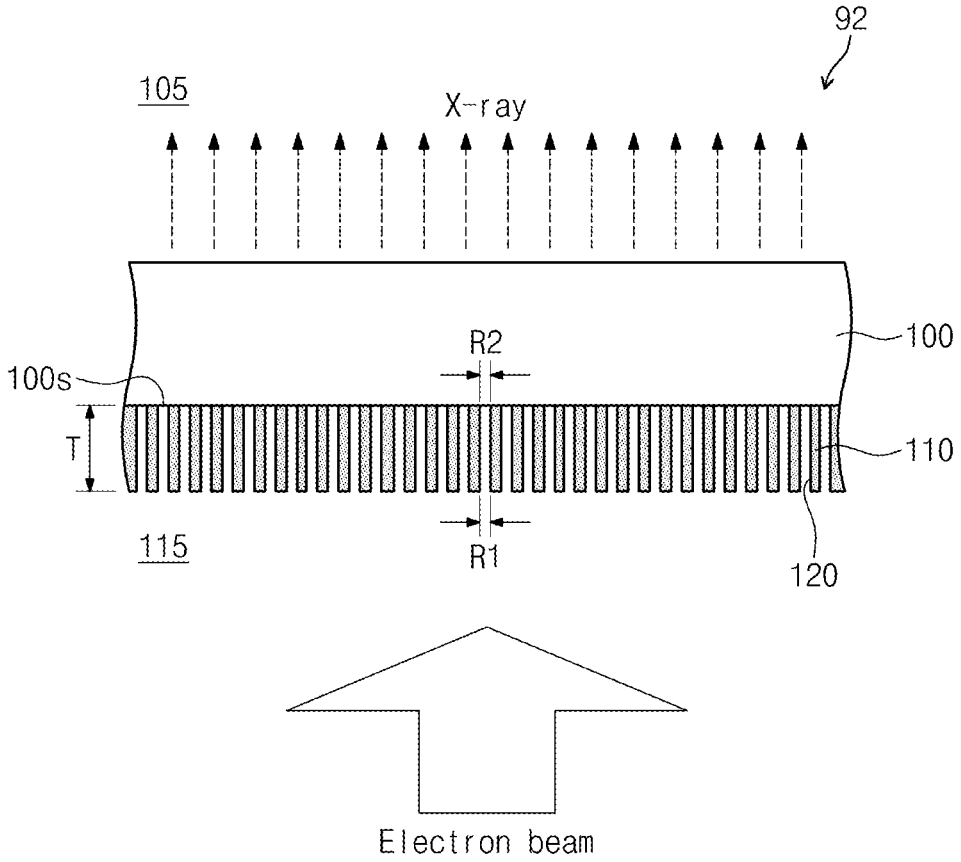
FIG. 3A is a cross-sectional view illustrating an X-ray tube according to another embodiment of the present invention.
Figure 3B:
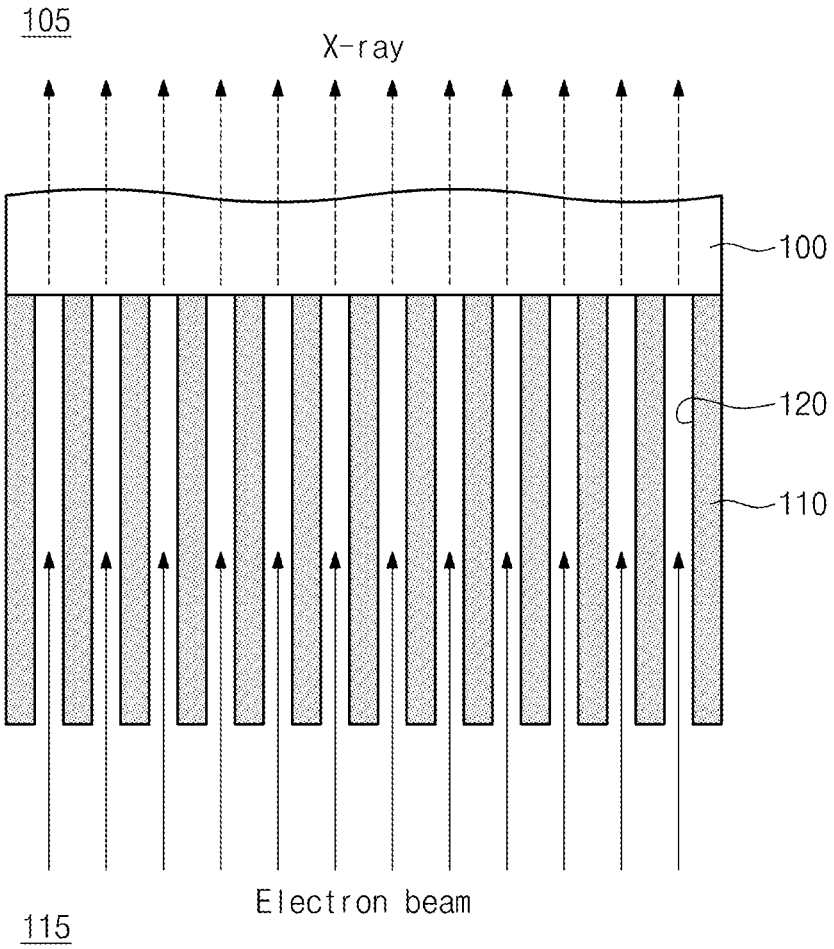
FIG. 3B is a cross-sectional view illustrating a portion of FIG. 3A.

FIG. 3A is a cross-sectional view illustrating an X-ray tube according to another embodiment of the present invention. FIG. 3B is a cross-sectional view illustrating a portion of FIG. 3A. Hereinafter, different features from the first embodiment will be described in detail, and the same feature will be omitted or roughly described.

Referring to FIG. 3A, an X-ray tube 92 may have a transmissive anode structure including an anode electrode 110 as an X-ray target deposited on an inner surface 100*s* of a window 100. In some embodiments, the anode electrode 110 may include a plurality of channels 120 passing through the anode electrode 110. The X-ray tube 92 may have an inner space 115 that is maintained in a vacuum state, and the outside 105 of the X-ray tube 92 may be in an atmospheric state in general.

An accelerated electron beam having high energy (for example, several tens of kV to several hundreds of kV) may be provided to the channels 130 to generate the X-ray. The X-ray may be emitted to the outside 105 of the X-ray tube 92 through the window 100.

Each of the channels 120 may have a unitary single structure having a cylindrical shape of which a diameter R1 of an inlet is substantially the same as a diameter R2 of an outlet. Each of the channels 120 having the cylindrical shape may have an inner sidewall vertically extending in a straight line.

Alternatively, each of the channels 120 may have a unitary single structure having a wedge shape of which the diameter R2 of outlet is less than the diameter R1 of the inlet, or may have a hybrid structure in which the cylindrical shape is combined with the wedge shape, as equal or similar to that of FIG. 2B. The diameters R1 and R2 of the channel 120 and a thickness T of the anode electrode 110 may be properly set according to energy of the electron beam and/or a material forming the anode electrode 110.

Referring to FIG. 3B, the accelerated electron beam may move into the inner space 115 and then be incident into the channels 120. The incident electron beam may impact on inner walls of the channels 120 to generate the X-ray. The generated X-ray may be emitted to the outside 105 through the window 100. For example, the X-ray may be emitted in parallel.

According to the current embodiment, since the electron beam impacts on the inner wall of the channels 120 each of which has a relatively great area, the electron beam may have relatively low energy density when compared to that of the electron beam focused on one spot. Therefore, the damage of the anode electrode 110 due to heat may be minimized in or removed.

According to the present invention, since the electron beam impacts on the inner wall having the fine channel to generate the X-ray, the energy density may be reduced when compared to that of the electron beam focused on any one spot of the anode electrode. Therefore, the damage of the anode electrode 110 due to heat may be minimized or removed.

The above detailed description of the present invention does not intend to limit the inventive concept to the disclosed embodiments. It will be understood by those skilled in the art that various changes in form and details may be made therein without departing from the spirit and scope of the invention as defined by the appended claims. Further, the appended claims should be appreciated as a step including even another embodiment.

What is claimed is:

1. An X-ray tube comprising:

an electrode on which an electron beam is incident to generate an X-ray; and a window disposed on the electrode, the generated X-ray from the electrode being transmitted through the window, wherein the electrode comprises a channel passing through the electrode, wherein the channel includes a lower channel having a truncated shape with an inclined inner sidewall and an upper channel having a cylindrical shape with a vertical inner sidewall extending from a top surface of the lower channel, a width of the top surface of the lower channel being equal to a width of a bottom surface of the upper channel, and wherein the electron beam is incident on the inner sidewall of the lower channel to generate the X-ray, the electron beam travelling from a bottom surface of the lower channel to the top surface of the lower channel.

2. The X-ray tube of claim 1, wherein a width of an inner portion of the lower channel gradually decreases from the bottom surface of the lower channel to the top surface of the lower channel.

3. The X-ray tube of claim 1, wherein the channel is a first channel, and wherein the electrode further comprises a second channel having substantially the same structure as the first channel.

4. The X-ray tube of claim 1, wherein the window is directly disposed on a top surface of the electrode, and wherein the top surface of the electrode corresponds to a top surface of the upper channel.

5. The X-ray tube of claim 1, wherein the channel completely passes through the electrode, and wherein the top surface of the lower channel corresponds to the bottom surface of the upper channel.

6. An X-ray tube comprising:

an X-ray window having a top surface facing outside the X-ray tube and a bottom surface facing inside the X-ray tube in a vacuum state; and an X-ray target disposed on the bottom surface of the X-ray window, an electron beam being incident on the X-ray target to generate an X-ray, wherein the X-ray target comprises a channel providing a traveling path through which the electron beam travels from the inside of the X-ray tube to the X-ray window, and wherein the channel includes a lower channel having a truncated shape with an inclined inner sidewall and an upper channel having a cylindrical shape with a vertical inner sidewall extending from a top surface of the lower channel, a width of the top surface of the lower channel being equal to a width of a bottom surface of the upper channel, the electron beam travelling from a bottom surface of the lower channel to the top surface of the lower channel.

7. The X-ray tube of claim 6, wherein the channel is a first channel, and wherein the X-ray target further comprises a second channel passing through the X-ray target and having substantially the same structure as the first channel.

8. The X-ray tube of claim 6, wherein the X-ray target comprises a polycrystalline or monocrystalline metal.

9. The X-ray tube of claim 6, wherein a width of an inner portion of the lower channel gradually decreases from the bottom surface of the lower channel to the top surface of the lower channel.

10. The X-ray tube of claim 6, wherein the X-ray window is directly disposed on a top surface of the X-ray target, and wherein the top surface of the X-ray target corresponds to a top surface of the upper channel.

11. The X-ray tube of claim 6, wherein the channel completely passes through the X-ray target, and wherein the top surface of the lower channel corresponds to the bottom surface of the upper channel.

12. An X-ray tube comprising:

an X-ray window having a top surface facing outside the X-ray tube in an atmospheric state and a bottom surface facing an inner space of the X-ray tube in a vacuum state;

a metal target disposed on the bottom surface of the X-ray window, an electron beam being incident on the metal target to generate an X-ray; and at least one channel passing through the metal target, the at least one channel providing a traveling path of the electron beam from the inner space to the outside, wherein the at least one channel comprises a first channel that includes a lower channel having a truncated shape with an inclined inner sidewall and an upper channel having a cylindrical shape with a vertical inner sidewall extending from a top surface of the lower channel, a width of the top surface of the lower channel being equal to a width of a bottom surface of the upper channel, the electron beam travelling from a bottom surface of the lower channel to the top surface of the lower channel.

13. The X-ray tube of claim 12, wherein the metal target comprises tungsten (W) or molybdenum (Mo).

14. The X-ray tube of claim 12, wherein the X-ray window comprises beryllium (Be).

15. The X-ray tube of claim 12, wherein a width of an inner portion of the lower channel gradually decreases from the bottom surface of the lower channel to the top surface of the lower channel.

16. The X-ray tube of claim 12, wherein the X-ray window is directly disposed on a top surface of the metal target, and wherein the top surface of the metal target corresponds to a top surface of the upper channel.

17. The X-ray tube of claim 12, wherein the channel completely passes through the metal target, and wherein the top surface of the lower channel corresponds to the bottom surface of the upper channel.

* * * * *